US005350503A

United States Patent [19]

Freymeyer et al.

[11] Patent Number: 5,350,503

[45] Date of Patent: Sep. 27, 1994

[54] METHOD OF PRODUCING CONSISTENT HIGH QUALITY COKE

[75] Inventors: Douglas A. Freymeyer, Everson; Richard L. Holloway, Bellingham; Ronald J. Kiracofe, Bellingham; Vijay R. Sampath, Bellingham, all of Wash.

[73] Assignee: Atlantic Richfield Company, Los Angeles, Calif.

[21] Appl. No.: 919,397

[22] Filed: Jul. 29, 1992

Related U.S. Application Data

[63] Continuation of Ser. No. 744,559, Aug. 13, 1992, abandoned.

[51] Int. Cl.[5] ..... C10G 9/14

[52] U.S. Cl. ..... 208/131; 208/50

[58] Field of Search ..... 208/131, 50

[56] References Cited

U.S. PATENT DOCUMENTS

| | | | |
|---|---|---|---|
| 1,983,688 | 12/1934 | Angell | 208/131 |
| 2,922,755 | 1/1960 | Hackley, Jr. | 208/39 |
| 3,617,480 | 11/1971 | Keel | 208/50 |
| 3,759,822 | 9/1973 | Folkins | 208/131 |
| 3,930,985 | 1/1976 | Schieber et al. | 208/131 |
| 4,075,084 | 2/1978 | Skripek et al. | 208/131 |
| 4,100,035 | 7/1978 | Smith | 208/131 |
| 4,130,475 | 12/1978 | Cameron et al. | 208/54 |
| 4,213,846 | 7/1980 | Sooter et al. | 208/131 |
| 4,235,700 | 11/1980 | Metrailer | 208/54 |
| 4,235,703 | 11/1980 | Kegler et al. | 208/131 |
| 4,247,387 | 1/1981 | Akbar | 208/131 |
| 4,332,671 | 6/1982 | Boyer | 208/131 |
| 4,466,883 | 8/1984 | Eickemeyer et al. | 208/131 |
| 4,492,625 | 1/1985 | Allan | 208/131 |
| 4,501,654 | 2/1985 | Allan | 208/131 |
| 4,521,277 | 6/1985 | Calderon | 208/131 |
| 4,624,775 | 11/1986 | Dickinson | 208/131 |
| 4,676,886 | 1/1987 | Rahbe et al. | 208/131 |
| 4,720,338 | 1/1988 | Newman et al. | 208/131 |
| 4,740,293 | 4/1988 | Dickinson et al. | 208/131 |
| 4,822,479 | 4/1990 | Fu et al. | 208/131 |
| 4,919,793 | 4/1990 | Mallari | 208/131 |
| 4,954,240 | 9/1990 | Eidt, Jr. et al. | 208/50 |
| 5,041,207 | 8/1991 | Harrington | 208/131 |
| 5,092,982 | 3/1992 | Becraft | 208/131 |
| 5,143,597 | 9/1992 | Sparks et al. | 208/131 |
| 5,158,668 | 10/1992 | Chahar et al. | 208/131 |

*Primary Examiner*—Helane Myers
*Attorney, Agent, or Firm*—Tom F. Pruitt

[57] ABSTRACT

A consistent high quality coke is produced by feeding a balancing stream comprising hydrocarbons to a delayed coking drum in addition to the heavy hydrocarbonaceous coker feedstock. The process of this invention reduces the contaminant content of coke by coking contaminant-containing residua and a reduced contaminant hydrocarbon balancing stream. Preferably, the balancing stream is a contaminant diluent, such as unreduced crude. The balancing stream may be a crude which is different from the base crude processed in the refinery crude tower and is preferably selected as a sulfur and/or metals diluent having a lower concentration of sulfur-containing or metal-containing compounds than the heavy coker feedstock.

23 Claims, 2 Drawing Sheets

METHOD OF PRODUCING CONSISTENT HIGH QUALITY COKE

This application is a continuation, of application Ser. No. 07/744,559 filed Aug. 13, 1992 now abandoned.

BACKGROUND OF THE INVENTION

1. Field of the Invention

This invention relates to an improved method of petroleum coking. In one aspect, this invention relates to a method of producing consistent high quality coke. In another aspect, this invention relates to a method of producing coke from feedstocks which have not been used previously as coker feedstocks.

2. Prior Art

Delayed coking is a well-known process used to convert heavy hydrocarbonaceous feedstocks to petroleum coke. Coking is used to process refinery streams, such as heavy residua, which cannot economically be further distilled, catalytically cracked or otherwise processed to make fuel-grade blend streams or streams which can be processed to make fuel-grade blend products. Heavy hydrocarbonaceous coker feedstocks are typically atmospheric residuum, vacuum residuum, catalytic cracker residual oils, hydrocracker residual oils and other residual oils from other refinery units.

Crude oil comprises hydrocarbons and hetero atoms, including heterocyclic compounds having non-metallic elements such as oxygen, nitrogen, sulfur, phosphorous, selenium and others, in complex ring structures, and compounds containing metals such as iron, vanadium and nickel. Sulfur-containing and metal-containing compounds, which are naturally occurring crude, can result in sulfur and/or metals contamination of coke product, adversely impacting coke uniformity and quality. These sulfur and metal-containing contaminant compounds become concentrated in residua which is used as coker feedstock, since the contaminant-containing compounds generally have relatively high boiling points and relatively complex molecular structures. Process economics dictate against separation or removal of the contaminant-containing compounds from the residua which is fed to a coker.

Coker feedstock is generally not just one residuum; it is a mixture of residua, which mixture varies depending upon refinery operations. Because of changes of composition and rates of flow of the various streams throughout an operating refinery, concentrations of sulfur-containing compounds and metal-containing compounds in the residua and coker feedstock change.

In delayed coking, a heavy hydrocarbonaceous feed for the coker is heated in a preheater external to the delayed coking drum to a temperature in the range of about 900° F. to about 1000° F., and the heated stream is fed to the coking drum. During the coking cycle, the coke drum is maintained at delayed coking conditions at a pressure in the range of about 20 psia to about 60 psia , and a temperature in the range of about 900° F. to about 1000° F. for a period of about 15 to about 30 hours, and the heavy hydrocarbonaceous feed is thermally cracked in the drum to form porous, solid coke and to form lighter hydrocarbons, which are vaporized and removed overhead from the drum during coking and are passed to a coker fractionator and recovered. Although some compounds containing sulfur and metals are removed during coking, the coke so formed in prior art processes generally contains residual sulfur and metals in amounts varying corresponding to variations of the amount of sulfur and metals found in the residua fed to the coker. At the end of the coking cycle, the feedstream is switched from the first drum to a second parallel coke drum, while the coke in the first drum is stripped by steam or other stripping media to remove recoverable hydrocarbons entrained or otherwise remaining in the coke, and the drum is cooled by steam or other cooling media to reduce the temperature of the drum while avoiding thermal shock to the coke drum and then is quenched by water or other quenching media to rapidly lower the drum temperature to conditions favorable for safe coke removal. The bottom and top heads of the drum are removed from the drum, and the coke is cut, typically by hydraulic water jet, and is removed from the drum. After coke removal, the drum heads are replaced and the drum is preheated and otherwise readied for the next coking cycle.

With such prior art delayed coking processes, coke quality is inconsistent and has a variable content of contaminants, including sulfur- and metal-containing compounds. Without consideration of coke quality, the coker is fed variable residua and other oils that are available in the refinery to be fed to the coker. The coke so formed varies with variations in the feed, including variations in the relative mixes of the residua of which the feed is comprised, relative compositions of the residua in the mixes, and in particular, variations in the concentrations of contaminants, such as sulfur and metals, in the residua.

There is a need for a method to control coke quality and to make high quality and consistent quality coke. While low and variable quality coke can be burned as fuel, high quality and consistent quality coke is desirable for certain industrial applications, such as anode-grade coke used in making consumable graphite electrodes useful in aluminum production.

DESCRIPTION OF THE INVENTION

We have discovered that a high quality and consistent quality coke can be produced by feeding a balancing stream to the delayed coking drum in addition to the heavy hydrocarbonaceous coker feedstock. Preferably, the balancing stream comprises hydrocarbon, and more preferably is a contaminant diluent, such as virgin crude or a slurry oil having a lower concentration of sulfur-containing compounds and/or metal-containing compounds than the heavy feedstock. The balancing stream may be a crude oil which is different in origin or composition from the base crude processed through the refinery crude unit, and is preferably selected to be low in sulfur, or metals, or both. We have found that consistent and high quality coke can be formed by evaluating the contaminant composition of the heavy hydrocarbon coker feedstream and of a balancing stream and then adjusting the coker feed mixture to comprise a consistent contaminant content. We have discovered a process which surprisingly reduces the contaminant content of coke by coking sulfur-containing and metal-containing residua and a reduced sulfur and reduced metals hydrocarbon balancing stream. In prior art refining operations, refiners have sought to recover light hydrocarbons from virgin crude for automotive and aircraft fuels, for petrochemical feedstocks, and for other products, rather than feed crude to a delayed coking drum to improve coke quality.

It is thus one object of this invention to provide a method of producing consistent high quality coke. Another object of this invention is to provide an improved delayed coking process which utilizes feedstocks which have not been used previously as coker feedstocks. A still further object of this invention is to provide a method to produce coke with consistent and reduced contaminant content.

In accordance with one embodiment of this invention in a delayed coking process wherein a heavy hydrocarbonaceous feedstock is fed to a delayed coking drum and is subjected to delayed coking conditions to form petroleum coke, the improvement comprises feeding to the delayed coking drum a feed of heavy hydrocarbonaceous feedstock and a balancing stream comprising hydrocarbon, having a different contaminant content than the heavy hydrocarbon feedstock. The term "contaminant", as used in the specification and claims, means a compound comprising sulfur or a compound comprising a metal, which metal component is selected from the group consisting of free metals or metal-containing compounds which occur naturally in crude oil, such as those comprising vanadium, nickel, iron, and the like. The term "different contaminant content", as used in the specification and claims, means a differing concentration of compounds comprising a sulfur component or a metal component. In one variation of this embodiment, the hydrocarbon balancing stream is a contaminant diluent. Preferred diluents are selected from the group consisting of virgin (not processed in any manner including desalting) unreduced crude oil, desalted unreduced crude oil, reduced crude, and mixtures thereof. The term "unreduced crude", as used in the specification claims, means crude which has not been distilled to separate out any portion of the light hydrocarbons therefrom, except as typically occurs at wellhead operations. The term "reduced crude", as used in the specification claims, means a crude which has been desalted and treated typically in a refinery crude tower to separate out a portion of the light hydrocarbons therefrom and which has a lower API gravity and higher contaminant content than unreduced crude, but has a higher API gravity and lower contaminant content than atmospheric tower bottoms or vacuum tower bottoms. Although the coker can be fed with a heavy hydrocarbon feedstock and a balancing stream comprising a second heavy residuum, which is deemed heavier by having a lower API gravity than the heavy hydrocarbon feedstock, such is not preferred, as the second heavy residuum would likely contain a higher concentration of contaminants over the heavy hydrocarbonaceous feedstock, resulting in a coke with a higher contaminant content. In one preferred variation, the delayed coking process in a component process of many combined processes in a refinery comprising a crude tower which processes a base crude which is a standard or available crude for such refinery and the balancing stream to the coking process is unreduced crude oil different from the base crude fed to the crude tower or is a crude having a different concentration of contaminant than said base crude.

In another variation of this embodiment of this invention, the contaminant content of the heavy hydrocarbon coker feedstock is determined either by direct measurement of the feedstock contaminant content or by computation of the results of measurements of the contaminant content of the individual streams of residua of which the heavy hydrocarbon feedstock is comprised, and the contaminant content of the heavy hydrocarbon balancing stream is also determined. Based upon such determinations, the rate of feed of the balancing stream to the coker is adjusted in response to changes in the contaminant concentration of the heavy hydrocarbon feedstock to maintain a consistent concentration of total contaminants fed to the coker. In an equivalent manner, the feedstock feed rate can be adjusted for a constant balancing stream flow rate.

In still another variation of this embodiment of this invention, the metals content of the heavy hydrocarbon coker feedstock is determined either by direct measurement of the feedstock metals content or by computation of the results of measurements of the metals content of the individual streams of residua of which the heavy hydrocarbon feedstock is comprised, and the metals content of the heavy hydrocarbon balancing stream is also determined. Based upon such determinations, the rate of feed of the balancing stream to the coker is adjusted in response to changes in the metals concentration of the heavy hydrocarbon feedstock to maintain a consistent concentration of total metals fed to the coker. In an equivalent manner, the feedstock feed rate can be adjusted for a constant balancing stream flow rate.

In another variation of this embodiment of this invention, the sulfur content of the heavy hydrocarbon coker feedstock is determined either by direct measurement of the feedstock sulfur content or by computation of the results of measurements of the sulfur content of the individual streams of residua of which the heavy hydrocarbon feedstock is comprised, and the sulfur content of the heavy hydrocarbon balancing stream is also determined. Based upon such determinations, the rate of feed of the balancing stream to the coker is adjusted in response to changes in the sulfur concentration of the heavy hydrocarbon feedstock to maintain a consistent concentration of total sulfur fed to the coker. In an equivalent manner, the feedstock feed rate can be adjusted for a constant balancing stream flow rate.

In another embodiment of this invention, a delayed coking process comprises feeding to a first fractionator a heavy hydrocarbonaceous feedstock, a hydrocarbon balancing stream having a different contaminant content than the heavy hydrocarbonaceous feedstock, and a coker overhead product stream, as a first fractionator feed. In the first fractionator, the feed is separated into an overhead fraction, a bottoms fraction, and side fraction, and at least a portion of the bottoms fraction is fed to a delayed coking drum which is operated under delayed coking conditions to form petroleum coke and a coker overhead product stream. Preferably, at least a portion of the side fraction is recovered as product. In a preferred variation of this embodiment, at least a portion of the overhead fraction of the first fractionator is fed to a second fractionator and is separated in the second fractionator into a first, lighter fraction and a second, heavier fraction. Preferably, at least a portion of the second, heavier fraction is fed to the first fractionator, and at least a portion of the first, lighter fraction is withdrawn as product. Still more preferably, at least a portion of the second, heavier fraction and the hydrocarbon balancing stream are passed through a heat exchange means wherein heat is transferred from the second, heavier fraction to the hydrocarbon balancing stream. In another variation of this embodiment, the first, lighter fraction is separated into a third fraction, a fourth fraction and a fifth fraction, wherein the fifth fraction has a boiling point intermediate between the third fraction and the fourth fraction, and the fifth fraction is withdrawn as product. Preferably, a portion of the fifth fraction is fed as recycle to the second fractionator. In another embodiment of this invention, the balancing stream, such as virgin unreduced crude oil, which comprises more light hydrocarbons than the heavy residua coker feed, is fed to the coker fractionator.

BRIEF DESCRIPTION OF THE DRAWINGS

FIG. 1 is illustrative of a prior art delayed coking process in which contaminant-containing heavy hydrocarbon feeds, such as vacuum tower bottoms 2, catalytic cracker slurry oil 4 and hydrocracker process residual oil 6 are combined with coker fractionator 28, bottoms 8, to form a heavy hydrocarbonaceous coker feedstock 10 and are heated in a furnace 12 to a temperature in the range of about 900° F. to about 1000° F. to form heated heavy hydrocarbon feedstock 14. During the coking cycle, the heated heavy hydrocarbon feedstock 14 is fed via conduit 15 to an online coke drum 20. An alternative, parallel second coke drum 18 is off coking cycle, and has alternative feed line 16 used when the drum 18 is online. During the coking cycle, the online drum 20 is maintained at delayed coking conditions at a pressure in the range of about 20.0psia to about 60.0 psia and at a temperature in the range of about 900° F. to about 1000° F. for about 15 to about 30 hours. During coking, vaporized hydrocarbons are removed from the drum 20 through conduits 22 and 26 are passed to the coker fractionator 28. For alternative drum 18, during its coking cycle, vaporized hydrocarbons are removed through conduits 24 and 26 and are passed to the coker fractionator 28. The coker fractionator 28 separates out light gases such as butane and lighter and passes them overhead through conduit 30 and separates out other product streams such as liquid product streams such as coker gas oil 32. The coker fractionator bottoms 34 can be recycled to the coker via conduit 8 or can be directed by conduit 36 for processing in other refinery units. Prior art processes as shown in FIG. 1 have not been operated to produce a consistent quality coke since variations in the rate of flow and metals content of heavy residua 2, 4 and 6 have not been monitored, adjusted or offset.

FIG. 2 shows an improved delayed coking process of this invention. Certain numbers in FIG. 1 are used in FIG. 2, and as used, have the same meaning as assigned in the foregoing description of FIG. 1. Feed 10 to the coker heater 12 comprises hydrocarbon residual oils 2, 4 and 6, and a balancing hydrocarbon feed 39 which, for the purpose of illustration, is desalted crude. Preferably, the rate of flow of the balancing hydrocarbon feed 39 is adjusted to maintain the contaminants content in the heated coker feedstream 14 constant. In another variation, the sulfur and/or metals content of the streams 2, 4 and 6 of which the heavy hydrocarbon coker feedstock is comprised is determined either by direct measurement of the feedstocks 2, 4 and 6 sulfur and/or metals content or by computation of the results of measurements of the sulfur and/or metals content of the individual streams 2, 4 and 6 of residua of which the heavy hydrocarbon feedstock is comprised. Based upon such determinations, the rate of feed of the balancing stream 39 to the coker 18 or 20 is adjusted in response to changes in the sulfur and/or metals concentration of the heavy hydrocarbon feedstocks 2, 4 and 6 to maintain a consistent concentration of total metals fed to the cokers 18 and 20. In another embodiment, also shown in FIG. 2, a balancing stream 40 is fed to the coker fractionator 28. Balancing streams 39 and 40 may be fed separately or concurrently.

FIG. 3 shows another embodiment of an improved delayed coking process of this invention. Certain numbers, as used in FIGS. 1 and 2, are used in FIG. 3 and, as used, have the same meaning assigned as in the foregoing description of FIGS. 1 and 2. In this embodiment, heavy hydrocarbon feedstocks 2, 4 and 6 are fed to a first fractionator 48. For purposes of illustration, feedstock 2 consists essentially of vacuum residuum, feedstock 4 consists essentially of cracked slurry oil and feedstock 6 consists essentially of recovered oil from various refinery waste streams and which has been stored in a recovered oil storage tank (not shown) prior to use. Feed to the fractionator 48 also comprises a balancing stream 40, which is preferably desalted crude. The balancing stream 40 can pass directly via conduit 44 to the first fractionator 48 or, preferably, is passed through heat exchanger 42 for preheating and then via conduit 44 to fractionator 48. The first fractionator 48, bottoms 46, is fed to the coker heater 12 and passes via conduit 14 and then either via conduit 15 or 16, to the coker 20 or 18, respectively, whichever is in the on-coking cycle. A quench oil stream 50 is added for control of the temperature in the coker overhead 26, which overhead passes to the first fractionator 48. In one variation, a drawstream 32 is taken as product from the first fractionator 48, which draw can be a heavy coker gas-oil draw for processing in other process units.

Figure 1:
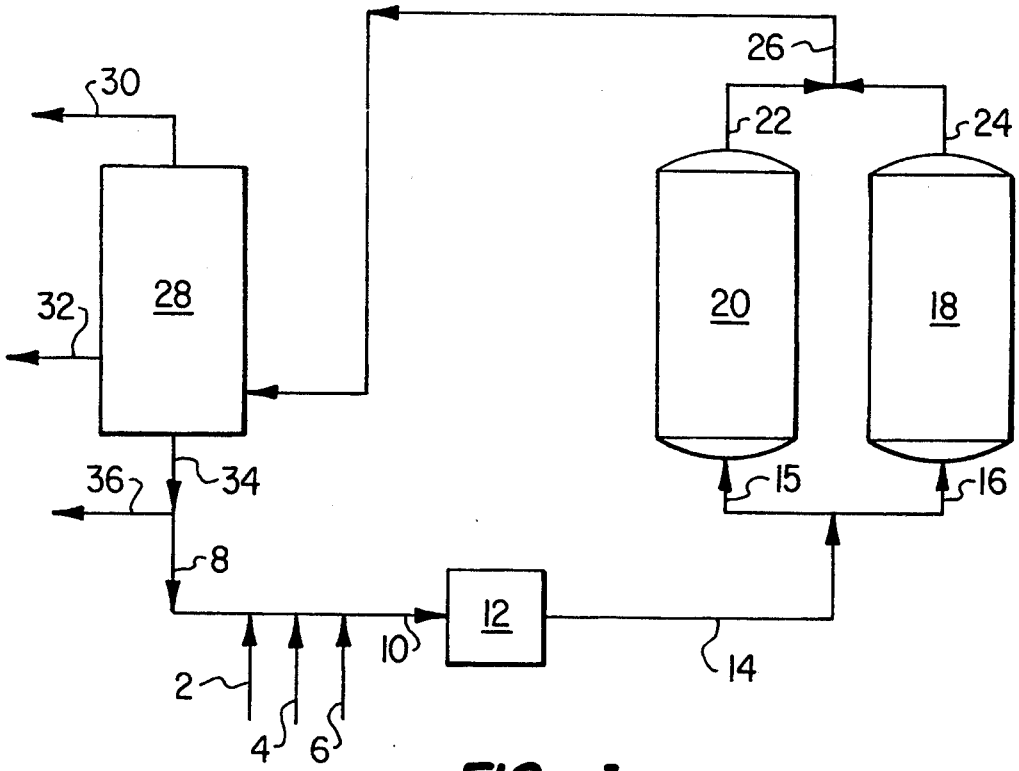
FIG. 1 is a schematic flow diagram of a prior art delayed coking process.
Figure 2:
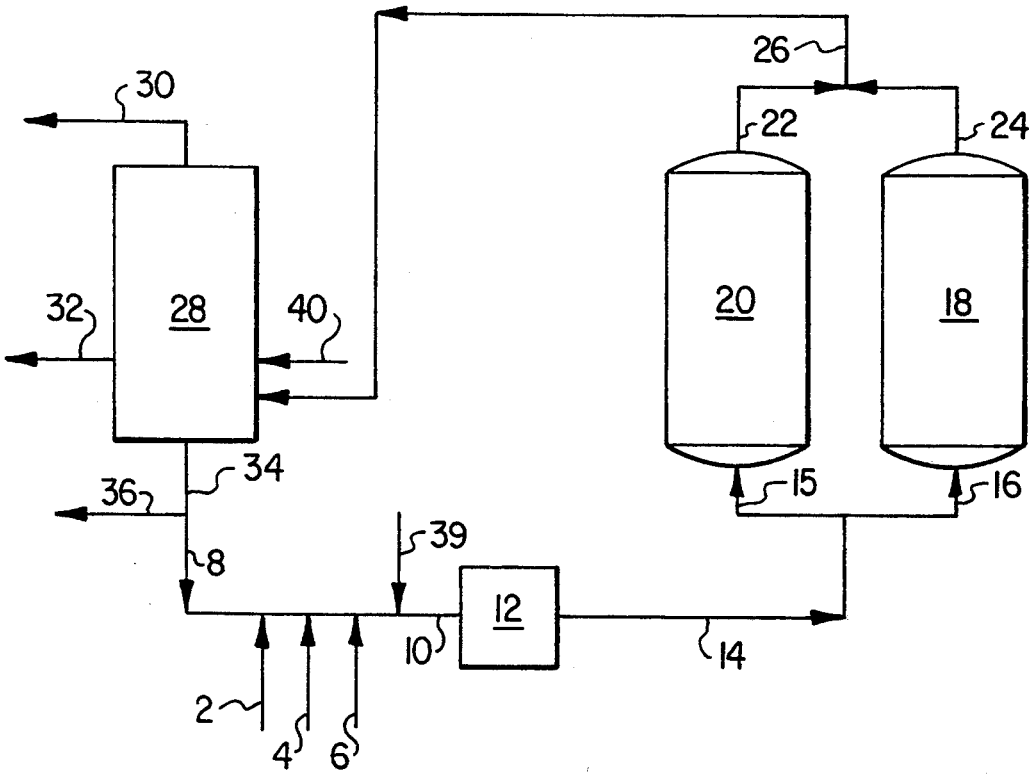
FIG. 2 is a schematic flow diagram of an embodiment of a delayed coking process of this invention wherein a heavy hydrocarbonaceous feedstock and a hydrocarbon balancing stream are fed to a coker or to a coker fractionator.
Figure 3:
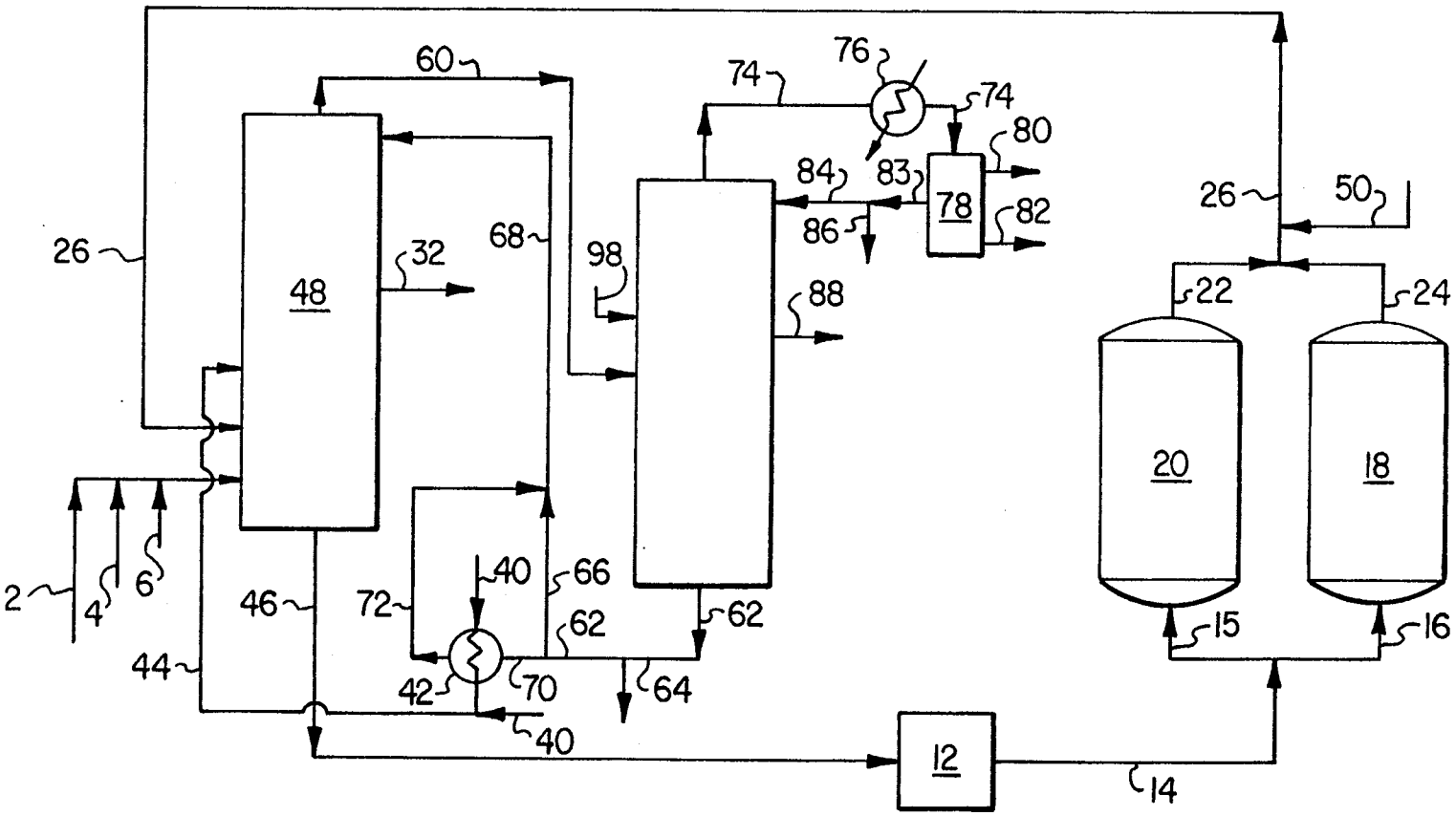
FIG. 3 is a schematic flow diagram of a second embodiment of a delayed coking process of this invention wherein a heavy hydrocarbonaceous feedstock and a hydrocarbon balancing stream are fed to a coker fractionator.

In the embodiment shown in FIG. 3, the overhead stream 60 from the first fractionator 48 is fed to a second fractionator 58. The bottom stream from the second fractionator 52 can be withdrawn via conduit 62 through conduit 64 as a light coker oil draw or can be passed via conduits 66 and 68 as reflux or recycle to the first fractionator 48. In a preferred variation of this embodiment of this invention, the coker bottoms 62 passes via conduit 70 through heater 42 to preheat the desalted crude 40 balancing stream in heat exchanger 42 for feed to the first fractionator 48 via conduit 44 and passes via conduit 72 through conduit 68 as recycle or reflux to the first fractionator 48.

The second fractionator 58 may be operated in various ways. Overhead stream 74 of the second fractionator 58 can be passed through cooler/condenser 76 to separator 78 where light gases are removed via conduit 80 and sour water is removed via conduit 82. A coker fractionator product stream 83 can pass via conduit 84 as reflux or recycle to the second fractionator 58 and as a coker fractionator product side draw 86 for processing or blending. Preferably, a drawstream 88 from the second fractionator 58 is removed in the jet, stove oil or other product temperature range, depending on overall operating conditions of the second fractionator 58. In other variations, additional streams can be fed to the second fractionator 58 for separation such as a rich oil stream 98 which is preferably selected from refinery streams in the jet or higher boiling range.

In one preferred variation of the embodiment shown in FIG. 3, the recovered oil stream 6, as fed to the first fractionator 48, has a boiling temperature in the range of about 100° F. to about 1000° F., second feed 4 and third stream 2, as residua, boil at a temperature not lower than about 900° F. and each have an unknown end point. The first fractionator 48 bottoms 46 is maintained at a temperature in the range of about 700° F. to about 800° F., as fed to the coker heater 12. The first fractionator 48 product draw 32 has a boiling temperature in the range of about 650° F. to about 800° F. with a draw temperature of about 625° F. to about 650° F., and the first fractionator 48 overhead 60 temperature is in the range of about 525° F. to about 575° F. The second fractionator 58 bottoms 62 and 70 preferably has a boiling temperature in the range of about 500° F. to about 700° F. as it passes through heat exchanger 42 with a draw temperature of stream 64 being in the range of about 500° F. to about 550° F. The desalted crude 40 is preferably maintained at a temperature of about 220° F. to about 290° F. at the input to exchanger 42 and is preferably maintained at a temperature in the range of about 500° F. to about 550° F. in conduit 44 as fed to the first fractionator 48. More preferably, it is desirable to preheat stream 40 to the highest temperature practical by heat exchange with stream 70. Selection of operating conditions of the second fractionator 58 overhead 74 and selection of rich oil feedstream 98 can be made depending upon the desired boiling range of product draws 80, 86, 88 and 64.

The process of the present invention has many surprising advantages. The overall capacity of the refinery to process crude is increased. Most refineries have a capacity limit at their crude and vacuum towers (not shown), caused by capacity limitations of reboilers, heaters, pumps, overhead condensers, reflux and associated piping. By directing crude to the coker or the coker fractionator which operates above atmospheric pressure, the capacity limitations of the crude and vacuum towers are avoided. In addition, the process of this invention provides for waste heat utilization, as shown in FIG. 3, in that the second fractionator 58 bottoms 62 and 70 can be used to heat balancing stream 40, such as a desalted crude, via heat exchanger 42 before the balancing stream 40 is fed via conduit 44 to the first fractionator 48, whereas processing the crude in a crude unit requires crude heater capacity. The heat transfer process of this invention reduces energy requirements as measured by overall amount of crude to be processed in the refinery. Another surprising advantage obtained by the practice of the method of this invention is increased utilization or availability of the coker heater 12 and the fractionating tower 48. The additional relatively light hydrocarbons (relatively light as compared to residua 2, 4 and 6) found in the balancing stream 40 and 44 which are not removed in the first fractionator 48 are mixed with the heavy residua 2, 4 and 6, and become a component of the fractionator 48 bottoms 46, and when vaporized in the convection section of coker heater 12, create more turbulence and higher tube velocities in the coker heater 12, resulting in reduced furnace 12 fouling. In addition, we have found that the heated balancing stream 44 added to the first fractionator 48 adds additional liquid in the bottom tray section (not shown) of the first fractionator 48, which additional liquids wash coke fines that may be entrained coke drum overhead 26 from the cokers 18 and 20 and may have passed to the first fractionator 48 and are entrained or migrate toward the first fractionator's 48 lower trays (not shown). In prior art processes, these coke fines tend to plug the fractionator trays, which plugging is avoided by the liquids' washing action of the present invention. In addition, the relatively cool feedstream 44, whether or not preheated in exchanger 42, to fractionator 48 serves as an internal reflux for the first fractionator tower 48, which permits increased capacity of the second fractionating tower 58 condenser 76, hence the cooling requirements on the second fractionator 58 condenser 76 are reduced by the internal reflux provided by the relatively cool crude feed 44.

Another surprising result discovered from the process of this invention is a change in crude economics in that a portion of the crude balancing stream 44 cracks in the cokers 18 and 20. Processing the crude in a crude unit would produce a heavy gas oil stream which is a low-value product; however, the crude processed in the coker is substantially cracked to light and middle distillates thereby minimizing the amount of low-value heavy oil product.

Variations of the foregoing invention may be made without departing from the spirit and scope thereof.

What is claimed is:

1. In a delayed coking process wherein a heavy hydrocarbonaceous feedstock comprising contaminant-containing compounds, wherein said contaminant is a compound comprising sulfur, is fed to a delayed coking drum and is subjected to delayed coking conditions to form petroleum coke, the improvement comprising: determining contaminant content of said heavy hydrocarbonaceous feedstock, determining contaminant content of a hydrocarbon balancing stream and feeding to said delayed coking drum a feed of said hydrocarbon balancing stream having a different contaminant content than said heavy hydrocarbonaceous feedstock, wherein said balancing stream is a contaminant diluent selected from the group consisting of virgin unreduced crude oil, desalted unreduced crude oil, reduced crude oil which has a lower API gravity and higher contaminant content than unreduced crude and which has a higher API gravity and lower contaminant content than atmospheric tower bottoms or vacuum tower bottoms, and mixtures thereof, wherein said hydrocarbon balancing stream is fed to said delayed coking drum at a rate which is adjusted in response to changes in concentration of contaminant-containing compounds of said heavy hydrocarbonaceous feedstock to maintain a consistent concentration of contaminants in said petroleum coke so formed.

2. A process in accordance with claim 1 wherein said delayed coking process is a component process of a refinery comprising a crude tower which processes a base crude and said balancing stream is an unreduced crude oil having a different concentration of contaminant than said base crude.

3. A delayed coking process comprising:

a. determining contaminant content of a heavy hydrocarbonaceous feedstock and determining contaminant content of a hydrocarbon balancing stream;

b. feeding to a first fractionator said heavy hydrocarbonaceous feedstock, said hydrocarbon balancing stream having a different concentration of a compound comprising sulfur than said heavy hydrocarbonaceous feedstock, wherein said balancing stream is a contaminant diluent selected from the group consisting of virgin unreduced crude oil, desalted unreduced crude oil, reduced crude oil which has a lower API gravity and higher contaminant content than unreduced crude and which has a higher API gravity and lower contaminant content than atmospheric tower bottoms or vacuum tower bottoms, and mixtures thereof, and a coker overhead product stream, as a first fractionator feed;

c. separating said first fractionator feed in said first fractionator into an overhead fraction, a bottoms fraction, and side fraction;

d. feeding to a delayed coking drum at least a portion of said bottoms fraction; and e. operating said delayed coking drum under delayed coking conditions to form petroleum coke and a coker overhead product stream; and f. adjusting rate of feed of said hydrocarbon balancing stream to said first fractionator in response to change in concentration of compound comprising sulfur of said heavy hydrocarbonaceous feedstock to maintain a consistent concentration of compound comprising sulfur in said petroleum coke so formed.

4. A process in accordance with claim 3 wherein said delayed coking process is a component process of a refinery comprising a crude tower which processes a base crude and said balancing stream is an unreduced crude oil having a different concentration of a compound comprising a sulfur component than said base crude.

5. A process in accordance with claim 3 wherein at least a portion of said side fraction is recovered as product.

6. A process in accordance with claim 3 wherein at least a portion of said overhead fraction is fed to a second fractionator.

7. A process in accordance with claim 6 wherein said overhead fraction is fed to a second fractionator and is separated in said second fractionator into a first, lighter fraction and a second, heavier fraction.

8. A process in accordance with claim 7 wherein at least a portion of said second, heavier fraction is fed to said first fractionator.

9. A process in accordance with claim 7 wherein at least a portion of said first, lighter fraction is withdrawn as product.

10. A process in accordance with claim 3 wherein at least a portion of said second, heavier fraction and said hydrocarbon balancing stream are passed through a heat exchange means wherein heat is transferred from said second, heavier fraction to said hydrocarbon balancing stream.

11. A process in accordance with claim 3 wherein said first, lighter fraction is separated into a third fraction, a fourth fraction and a fifth fraction, wherein said fifth fraction has a boiling point intermediate between said third fraction and said fourth fraction, and said fifth fraction is withdrawn as product.

12. In a delayed coking process wherein a heavy hydrocarbonaceous feedstock comprising contaminant-containing compounds, wherein said contaminant is a compound comprising a metal component, is fed to a delayed coking drum and is subjected to delayed coking conditions to form petroleum coke, the improvement comprising determining contaminant content of said heavy hydrocarbonaceous feedstock, determining contaminant content of a hydrocarbon balancing stream and feeding to said delayed coking drum a feed of said hydrocarbon balancing stream having a different contaminant content than said heavy hydrocarbonaceous feedstock, wherein said balancing stream is a contaminant diluent selected from the group consisting of virgin unreduced crude oil, desalted unreduced crude oil, reduced crude oil which has a lower API gravity and higher contaminant content than unreduced crude and which has a higher API gravity and lower contaminant content than atmospheric tower bottoms or vacuum tower bottoms, and mixtures thereof wherein said hydrocarbon balancing stream is fed to said delayed coking drum at a rate which is adjusted in response to changes in concentration of contaminant-containing compounds of said heavy hydrocarbonaceous feedstock to maintain a consistent concentration of contaminants in said petroleum coke so formed.

13. A process in accordance with claim 12 wherein said delayed coking process is a component process of a refinery comprising a crude tower which processes a base crude and said balancing stream is an unreduced crude oil having a different concentration of contaminant than said base crude.

14. A process in accordance with claim 12 wherein said hydrocarbon balancing stream is fed to said delayed coking drum at a rate which is adjusted in response to changes in the concentration of a compound comprising a metal component in said heavy hydrocarbonaceous feedstock to maintain a consistent concentration of a compound comprising a metal component in said petroleum coke so formed.

15. A delayed coking process comprising:

a. determining contaminant content of a heavy hydrocarbonaceous feedstock and determining contaminant content of a hydrocarbon balancing stream;

b. feeding to a first fractionator said heavy hydrocarbonaceous feedstock, said hydrocarbon balancing stream having a different concentration of a compound comprising a metal component than said heavy hydrocarbonaceous feedstock, wherein said balancing stream is a contaminant diluent selected from the group consisting of virgin unreduced crude oil, desalted unreduced crude oil, reduced crude oil which has a lower API gravity and higher contaminant content than unreduced crude and which has a higher API gravity and lower contaminant content than atmospheric tower bottoms or vacuum tower bottoms, and mixtures thereof, and a coker overhead product stream, as a first fractionator feed;

c. separating said first fractionator feed in said first fractionator into an overhead fraction, a bottoms fraction, and side fraction;

d. feeding to a delayed coking drum at least a portion of said bottoms fraction;

e. operating said delayed coking drum under delayed coking conditions to form petroleum coke and a coker overhead product stream; and f. adjusting rate of feed of said hydrocarbon balancing stream to said first fractionator in response to change in concentration of compound comprising a metal component of said heavy hydrocarbonaceous feedstock to maintain a consistent concentration of compound comprising a metal component in said petroleum coke so formed.

16. A process in accordance with claim 15 wherein said delayed coking process is a component process of a refinery comprising a crude tower which processes a base crude and said balancing stream is an unreduced crude oil having a different concentration of a compound comprising a metal component than said base crude.

17. A process in accordance with claim 15 wherein at least a portion of said side fraction is recovered as product.

18. A process in accordance with claim 15 wherein at least a portion of said overhead fraction is fed to a second fractionator.

19. A process in accordance with claim 18 wherein said overhead fraction is fed to a second fractionator and is separated in said second fractionator into a first, lighter fraction and a second, heavier fraction.

20. A process in accordance with claim 19 wherein at least a portion of said second, heavier fraction is fed to said first fractionator.

21. A process in accordance with claim 19 wherein at least a portion of said first, lighter fraction is withdrawn as product.

22. A process in accordance with claim 15 wherein at least a portion of said second, heavier fraction and said hydrocarbon balancing stream are passed through a heat exchange means wherein heat is transferred from said second, heavier fraction to said hydrocarbon balancing stream.

23. A process in accordance with claim 15 wherein said first, lighter fraction is separated into a third fraction, a fourth fraction and a fifth fraction, wherein said fifth fraction has a boiling point intermediate between said third fraction and said fourth fraction, and said fifth fraction is withdrawn as product.

* * * * *